United States Patent [19]

Shirasawa et al.

[11] Patent Number: 4,723,960

[45] Date of Patent: Feb. 9, 1988

[54] PROCESS FOR SCOURING AND DYEING SYNTHETIC FIBERS IN ONE-BATH WITH A PH-ADJUSTING AGENT

[75] Inventors: Kiyoshi Shirasawa, Kyoto; Akira Hashimoto, Osaka; Hirotugu Kodama, Shiga; Ichiro Osawa; Yasunori Ito, both of Kyoto; Masazi Yamasaki, Osaka, all of Japan

[73] Assignee: Meisei Chemical Works, Ltd., Kyoto, Japan

[21] Appl. No.: 789,723

[22] Filed: Oct. 21, 1985

[30] Foreign Application Priority Data

Jul. 30, 1985 [JP] Japan ..... 60-169282

[51] Int. Cl.[4] ..... C09B 67/00

[52] U.S. Cl. ..... 8/495; 8/137; 8/494; 8/582; 8/611; 8/612; 8/614; 8/922; 8/583

[58] Field of Search ..... 8/494, 582, 611, 612, 8/495

[56] References Cited

U.S. PATENT DOCUMENTS

| | | | |
|---|---|---|---|
| 3,980,428 | 9/1976 | Fabbri et al. | 8/578 |
| 4,168,142 | 9/1979 | Hervot et al. | 8/638 |
| 4,252,531 | 2/1981 | Daeuble et al. | 8/531 |
| 4,568,351 | 2/1986 | Cardona et al. | 8/582 |

*Primary Examiner*—A. Lionel Clingman

*Attorney, Agent, or Firm*—Morgan & Finnegan

[57] ABSTRACT

According to the process of the invention, scouring and dyeing synthetic fibers can be carried out in one-bath. The process comprises the steps of preparing a dyeing solution comprising an alkalizing agent and a pH adjusting agent being able to generate acids by heating, putting unscoured synthetic fibers in said dyeing solution and then heating to dye said fibers at high temperature. The dyeing solution may comprise a surface active agent.

3 Claims, No Drawings

PROCESS FOR SCOURING AND DYEING SYNTHETIC FIBERS IN ONE-BATH WITH A PH-ADJUSTING AGENT

BACKGROUND OF THE INVENTION

This invention relates to a process for scouring and dyeing synthetic fibers in one-bath.

Synthetic fibers have been usually scoured by means of a continuous or batch scouring machine for the removal of oils and sizing agents adhered thereto prior to the dyeing. However, it has been recently needed to economize energy and save labor in many industrial fields. In the case of dyeing synthetic fibers, it has been much desired to scour and dye the fibers simultaneously in one-bath.

As to knitted fabrics of synthetic fibers, a process for scouring and dyeing in one-bath, though it is somewhat unsatisfactory, has been already applied, because the fabrics, in general, comprise only oils adhered thereto and the oils can be substantially removed by using an adequate surface active agent.

However, as to woven fabrics, a great amount of sizing agents of polyvinyl alcohol, polyester or polyacrylic ester which are adhered to the fabrics must be removed together with oils. There have been made many studies of removal of such sizing agents by using surface active agents. But satisfactory results have not been obtained. For scouring the woven fabrics, singular use of a surface active agent is scarcely effective, and an alkalizing agent is necessitated. On the other hand, for dyeing synthetic fibers with acid or disperse dyes, the dye bath must be made acidic so that the stability and good adsorption of the dyes can be achieved.

As described above, a bath when used for scouring must be made alkaline while one for dyeing must be adjusted to be acidic, which has prevented the synthetic fibers from being scoured and dyed simultaneously in one-bath.

It is, therefore, the primary object of this invention to provide a process for scouring and dyeing synthetic fiber fabrics simultaneously in one-bath, which is able to adjust the pH value of the one-bath to be within the ranges suitable for scouring and dyeing.

SUMMARY OF THE INVENTION

The process for scouring and dyeing synthetic fibers in one-bath according to the invention comprises the steps of prepering a dyeing solution which comprises an alkalizing agent and a pH adjusting agent being able to generate acids by heating, putting unscoured synthetic fibers in the dyeing solution and then heating to dye the synthetic fibers at high temperature.

As the pH adjusting agent, there may be used at least one compound selected from the group consisting of halogenated hydrocarbons, halogenated alcohols, halogenated alkyl oxysilanes and mono-, di-, or poly-carboxylic esters.

The dyeing solution may comprise surface active agents together with the alkalizing agent.

DETAILED DESCRIPTION OF THE INVENTION

According to the invention utilizing the specific pH adjusting agent with an alkalizing agent, the dyeing solution remains at first alkaline to scour the synthetic fibers, but is made acidic by acids generated from the pH adjusting agent with increasing temperature to dye the fibers, whereby the synthetic fibers are scoured and dyed in one-bath within the respective most adequate pH ranges.

According to a preferred embodiment of the invention, a pH adjusting agent, an alkalizing agent and a surface active agent are added to water together with dyes such as disperse dyes or acid (premetallized acid) dyes to prepare a dyeing solution. For example, unscoured polyester fibers are dyed in the dyeing solution under high pressure at a temperature of from 120° C. to 140° C. While the temperature is rising toward 100° C., the bath remains alkaline due to the added alkalizing agent, and the polyester fibers are scoured to remove oil and sizing agent from the fibers into the bath. The released oil and sizing agent are emulsified in the bath due to the added surface active agent. When the temperature exceeds about 100° C., the pH adjusting agent is decomposed with the alkalizing agent and free acids gradually produced make the dye bath nuetral and then acidic. In brief, the bath of the invention is initially alkaline, and is made neutral and thereafter acidic depending on the rise of the bath temperature, whereby the scouring and the dyeing are carried out within the respective most adequate pH regions.

It is known that alkalizing agents deteriorate disperse dyes to cause the de-composition and the unsufficient adsorption particularly at a temperature of about 100° C. or more. However, according to the process of the invention, the dyeing solution is neutral near 100° C., and is made acidic at a temperature of 120° C. to 140° C. Therefore, the adsorption and absorption of dyes is not hazardously affected by the alkalizing agent. As compared with a conventional way, the process of the invention gives products excellent in level dyeing effect without sacrificing the dyeing property or degree of dyeing power, because the adsorption of dyes proceeds gently along with decreasing the pH value of the dyeing solution due to generation of acids from pH adjusting agent by heating.

Hereinafter, typical chemicals for use in the process of the invention are illustrated. As alkalizing agents, there are included sodium hydroxide, potassium hydroide, sodium carbonate, potassium carbonate, sodium tertiary phosphate, potassium tertiary phosphate, sodium tripolyphosphate, potassium tripolyphosphate, sodium pyrophosphate, potassium pyrophosphate, sodium metaphosphate, potassium metaphosphate, sodium metasilicate, potassium metasilicate and the like. Any alkalizing agents used in a conventional scouring process are useful and the agents may be use singularly or in combination.

As the surface active agent which is used in the process of the invention to emulsify the released sizing agents and to prevent redeposition the agents to fibers, there are not suitable those which influence badly the dyeing properties, e.g., arise the aggregation and tarring of dyes. Accordingly, the surface acitive agent is preferably selected from the group consisting of nonionic surface active agents and anionic surface active agents, which may be used singularly or in combination.

Among the preferred surface active agents, there are included alkylene oxide adducts of higher fatty acids such as lauric acid, ricinoleic acid, palmitic acid, stearic acid, linolic acid, linolenic acid, oleic acid and the like; alkylene oxide adducts of higher alcohols such as decyl alcohol, isodecyl alcohol, lauryl alcohol, stearyl alcohol, isostearyl alcohol, oleyl alcohol and the like; alkylene oxide adducts of phenol derivatives such as octyl phenol, dinonyl phenol, benzyl phenol, benzyl cyclohexyl phenol, styryl phenol and the the like; and/or sulfon ates thereof. Moreover, high molecular anionic surface active agents such as sodium polyacrylate, sodium polymaleate and the like are included.

As the pH adjusting agents useful in the process of the invention, there are included (1) halogenated hydrocarbons, (2) halogenated alcohols, (3) epihalohydrins and (4) mono-, di-, or poly-carboxylic esters.

As the preferred halogenated hydrocarbons, there are included such as carbon tetrachloride, methyl chloride, ethyl chloride, methylene chloride, trichloroethane, trichloroethylene, hexachloroethane, perchloroethylene, tetrachloroethane, propyl bromide and the like. Methylene chloride is the most preferable.

As the preferred halogenated alcohols, there are exemplified mono (or di or tri) chloro (or bromo) alkylalchohls ($C_2$–$C_5$), 3-chloro-1,2-propylene glycol, 2,2,3-tri-chlorobutane-1,1-diol, dibromoneopentyl glycol, 1-bromo-3-chloro-2-propanol and the like are exemplified. Dichloropropanol is the most preferable.

As the preferred epihalohydrins there are included epichlorohydrin, β-methyl epichlorohydrin, epibromohydrin and the like.

As the preferred mono-, di-, or poly-carboxylic esters, there are included the esters of carboxylic acids, e.g., mono- carboxylic acid such as formic acid, acetic acid, propionic acid, acrylic acid, methacrylic acid, tiglic acid, benzoic acid, monochloroacetic acid, monochlorocarbonic acid and the like, dicarboxylic acids such as oxalic acid, malonic acid, succinic acid, glutaric acid, adipic acid, methylsuccinic acid, malic acid, tartaric acid, phthalic acid and the like, and polycarboxylic acids such as citric acid, tricarboxylic acid, polyacrylic acid, polymethacrylic acid and the like, and alcohols, e.g., comparatively lower alcohols such as methyl alcohol, ethyl alcohol, propyl alcohol, butyl alcohol and the like, and glycols having the followiong general formula, $$HO-(\overset{\overset{R}{|}}{CH}-CH_2O)_nH,$$

wherein R presents H or CH3 and n presents a number between 1 and 5, such as ethylene glycol, diethylene glycol, propylene glycol, dipropylene glycol and the like. The esters may be mono-, di-, or poly-ester. The most preferred carboxylic ester is one which can produce free carboxylic acids with high acidity by the hydrolysis.

The used amount of each of the surface acitive agent, the alkalizing agents or the pH adjusting agent is within the range of from 0.1 g/1 to 5.0 g/1. The amount of the pH adjusting agent varies depending on the amount and type of the alkalizing agent used, and must be such that free carboxylic acids produced by the hydrolysis neutralize the alkalizing agent and further make the dyeing solution acidic.

The process of the invention may be applied to any fibrous articles particularly including unscoured synthetic fibers. The fibrous articles include yarns, knitted fabrics, woven fabrics and nonwoven fabrics which are singularly made of synthetic fibers, and also blended yarn fabrics, union knitted fabrics, and union cloth which contain another fibers besides synthetic ones.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE (1)

(1-A) 10g of unscoured polyester taffeta was put in a bath of an experimental dyeing machine (MINICOLOUR 12 manufactured by Tekusamu Giken Kabusiki Kaisha) containing 3 g/1 of dimethyl adipate, 2 g/1 of sodium tripolyphosphate and 1 g/1 of poly(17)oxyethylene nonyl phenol ether at a bath ratio of 1:10, and treated at 110° C. for 2 minutes. After the bath was cooled to 40° C., the taffeta was taken out of the bath, rinsed with water and dried to obtain sample A.

(1-B) The same manner as in (1-A) was repeated except that the treatment was carried out at 130° C. for 45 minutes to obtain sample B.

The scouring characteristics (removability of sizing agent) of the treated samples A and B were evaluated by dyeing them in 0.1% aqueous solution of cationic dye (MAXILON BLUE 5G manufactured by Bayer Aktiengesellschaft) at 50 ° C. for 2 minutes and examining the adsorption of the dye on sizing agent.

The adsorption of the cationic dye on taffeta was not appreciated in each of samples A and B. The result has revealed that the sizing agent adhered to the unscoured polyester fatteta was completely released into the bath by treating it at 110° C. for 2 minutes, and the released sizing agent was not redeposited to the fabric during the treatment at 130° C. for 45 minutes.

Further, since the released sizing agent was stably emulsified, the treatment solution became transparent milky blue but any aggregation of the released sizing agent was not recognized.

EXAMPLE (2)

(2-A) With use of the same machine as used in EXAMPLE (1), 10 g of unscoured triacetate fabric was treated in a bath containing 1 g/1 of butyl acetate, 1g/1 of dimethyl oxalate, 2 g/1 of sodium carbonate and 1 g/1 of sulfate of poly(17)oxyethylene nonyl phenol ether, at a bath ratio of 1:10, at 100° C. for 2 minutes to obtain sample C.

(2-B) The same manner as in (2-A) was repeated except that the treatment was carried out at 120° C. for 30 minutes to prepare sample D.

The scouring characteristics (removability of sizing agent) of the treated samples C and D were evaluated in the same manner as in EXAMPLE (1). The scouring effect was remarkable and aggregation of the released sizing agent was not recognized.

EXAMPLE (3)

10 g of unscoured polyester jersey was treated in a bath containing 2 g/1 of dichloro-propanol, 1 g/1 of sodium tertiary phosphate and 1 g/1 of poly(20)-oxyetylenedibenzyl cyclohexyl phenol ether in the same manner as in the method (1-A) of EXAMPLE (1).

The scouring characteristics (degreasing property) of the treated material were evaluated by extracting oil and fat from the treated and untreated materials in Soxhlet's extractor with methanol and determining the amount of oil and fat remaining in the treated material. The result was excellent as follows;

the amount of oil and fat adhered to the untreated polyester jersey 2.95%(o.w.f.)

the amount of oil and fat adhered to the treated polyester jersey 0.13%(o.w.f.).

The treatment solution was transparent milky blue as in EXAMPLE (1).

EXAMPLE (4)

With use of the same machine as used in EXAMPLE (1), 10 g of unscoured polyester twill was dyed at a bath ratio of 1:10 in a dyeing solution containing 3 g/1 of hydroxyethyl monochloroacetate 2 g/1 of sodium tripolyphosphate and 1 g/1 of poly(20)oxyethylenedibenzyl cyclohexyl phenol ether, at 130° C. for 45 minutes.

EXAMPLE (5)

With use of the same machine as used in EXAMPLE (1), 10 g of unscoured polyester twill was dyed at a bath ratio of 1:10 in a dyeing solution containing 3 g/1 of dimethyl adipate, 1 g/1 of sodium hydroxide and 1 g/1 of sodium polyacrylate having a molecular weight of 4500 to 5000, at 130° C. for 45 minutes.

CONTROL (1)

In a bath containing 2 g/1 of sodium carbonate and 2 g/1 of poly(20)oxyethylene nonyl phenol ether, 10 g of unscoured polyester twill was scoured at 90° C. for 30 minutes, rinsed with water and dried. Thereafter, the scoured material was dyed with use of the same machine as used in EXAMPLE (1), in a dyeing solution having a pH value adjusted to 5.5 with acetic acid according to a usual method, at a bath ratio of 1:10 and at 130° C. for 45 minutes.

CONTROL (2)

With use of the same machine as used in EXAMPLE (1), 10 g of unscoured polyester twill was dyed in a dyeing solution containing 1 g/1 of sodium hydroxide and 2 g/1 of sulfate of poly(10)oxypropylenenonyl phenol ether at a bath ratio of 1:10 and at 130° C. for 45 minutes.

The dyeing tests of EXAMPLES (4), (5) and CONTROLS (1), (2) were carried out by using the following dyes:

| | |
|---|---|
| 1. Sumikaron Brilliant Red SE-BGL | 3.0% (o.w.f.) |
| 2. Sumikaron Yellow E-GRL | 1.0% (o.w.f.) |
| 3. Dianix Pink KR-SE | 1.0% (o.w.f.) |
| 4. Kayalon poly Orenge B conc | 0.5% (o.w.f.) |
| 5. Sumikaron Blue E-FBL | 0.5% (o.w.f.) |

Note: 1, 2 and 5 are dyestuffs manufactured by Sumitomo Chemical Kabusiki Kaisha, 3 is a dyestuff manufactured by Mitsubisi Kasei Kabusiki Kaisha, and 4 is a dyestuff manufactured by Nihon Kayaku Kogyo Kabusiki Kaisha.

Changes in pH value of the dyeing solution of EXAMPLE (4), (5) and CONTROLS (1), (2) and the level dyeing effect and the degree of exhaustion (build-up property) of the dyed fabrics are shown in TABLE 1 and 2, respectively.

The methods for evaluating the level dyeing effect and the dyeing property and for measuring the pH values are as follows:

A. Level dyeing effect

The dyed fabrics are visually observed, and evaluated according to the following criteria:

○ no color irregularities; good levelling

Δ slight color irregularities

X much color irregularities

B. Dyeing property

The reflectance of each fabric is measured by using a digital color difference meter manufactured Nihon Denshoku Kogyou Kabusiki Kaisha, the K/S value is calculated from the Kubelka-Munk's equation by using the obtained reflectance, and the relative dyeing rate (%) is obtained from the following formula:

$$\text{relative dyeing rate (\%)} = \frac{K/S \text{ value of dyed fabric}}{K/S \text{ value of dyed fabric of CONTROL (1)}} \times 100$$

C. pH Value of Dyeing Solution

A part of the solution is taken out during the dyeing, and cooled to room temperature. Thereafter, the pH value is measured by using a pH meter.

TABLE 1

| | (pH value of dyeing solution) | | | |
|---|---|---|---|---|
| | | | 130° C. | |
| bath temperature | 40° C. | 100° C. | initial | 45 min |
| CONTROL (1) | 5.5 | 5.5 | 5.5 | 5.5 |
| CONTROL (2) | 11.6 | 11.6 | 11.6 | 11.6 |
| EXAMPLE (4) | 9.5 | 6.5 | 6.5 | 5.9 |
| EXAMPLE (5) | 11.6 | 7.0 | 6.5 | 6.2 |

TABLE 2

| | Levelling | Relative dyeing rate (%) dye | | | | |
|---|---|---|---|---|---|---|
| | | 1 | 2 | 3 | 4 | 5 |
| CONTROL (1) | Δ | 100 | 100 | 100 | 100 | 100 |
| CONTROL (2) | X | 25 | 7 | 76 | 91 | 89 |
| EXAMPLE (4) | ○ | 98 | 97 | 96 | 100 | 98 |
| EXAMPLE (5) | ○ | 94 | 95 | 95 | 100 | 96 |

What is claimed is:

1. A process for scouring and dyeing synthetic fibers in one-bath, which comprises the steps of preparing a dyeing solution comprising a dye, a surface active agent selected from the group consisting of nonionic surface active agents and anionic surface active agents, an alkalizing agent and a pH adjusting agent being able to generate acids when by heating, said pH adjusting agent selected from the group consisting of mono (or di or tri)-chloro (or bromo) alkylalcohols ($C_2$ to $C_5$), 3-chloro-1,2-propylene glycol, 2,2,3-tri-chlorobutane-1,1-diol, dibromoneopentyl glycol, 1-bromo-3-chloro-2-propanol, epichlorohydrin, β-methyl epichlorohydrin, epibromohydrin and mono-, di- or poly-carboxylic esters produced by the reaction of formic acid, acetic acid, propionic acid, acrylic acid, methacrylic acid, tiglic acid, benzoic acid, oxalic acid, malonic acid, succinic acid, glutaric acid, adipic acid, methylsuccinic acid, malic acid, tartaric acid, phthalic acid, citric acid, tricarballylic acid, polyacrylic acid or polymethacrylic acid with methyl alcohol, ethyl alcohol, propyl alcohol, butyl alcohol, ethylene glycol, diethylene glycol, propylene glycol or dipropylene glycol; putting unscoured synthetic fibers in said dyeing solution and then heating to dye said fibers at a temperature of 120° C. to 140° C.

2. A process as defined in claim 1, wherein said pH adjusting agent is at least one compound selected from the group consisting of dichloropropanol, dimethyladipate, dimethylphthalate and dimethylsuccinate.

3. A process as defined in claim 1, wherein said mono-, di- or poly-carboxylic esters are those which can produce free carboxylic acids with high acidity by hydrolysis.

* * * * *